US005322134A

United States Patent [19]

Dahn

[11] Patent Number: 5,322,134

[45] Date of Patent: Jun. 21, 1994

[54] DRILL HEAD

[75] Inventor: Rolf Dahn, Bretten, Fed. Rep. of Germany

[73] Assignee: KSK Guided Microtunneling Technologies GmbH Spezialtiefbaugerate, Ettlingen, Fed. Rep. of Germany

[21] Appl. No.: 820,619

[22] PCT Filed: Mar. 25, 1991

[86] PCT No.: PCT/EP91/00572

§ 371 Date: Mar. 10, 1992

§ 102(e) Date: Mar. 10, 1992

[87] PCT Pub. No.: WO91/19074

PCT Pub. Date: Dec. 12, 1991

[30] Foreign Application Priority Data

May 25, 1990 [DE] Fed. Rep. of Germany ..... 4016965

[51] Int. Cl.[5] ..... E21B 10/60

[52] U.S. Cl. ..... 175/21; 175/424

[58] Field of Search ..... 175/21, 337, 339, 340, 175/424

[56] References Cited

U.S. PATENT DOCUMENTS

| | | | |
|---|---|---|---|
| 2,324,102 | 7/1943 | Miller et al. . | |
| 2,783,972 | 5/1957 | Fehlmann | 255/24 |
| 2,805,043 | 9/1957 | Williams, Jr. | 175/424 X |
| 3,211,244 | 10/1965 | Cordary | 175/61 |
| 3,269,471 | 8/1966 | Alexander | 175/418 |
| 3,324,957 | 6/1967 | Goodwin et al. | 175/67 |
| 3,386,521 | 6/1968 | Chadderdon et al. | 175/424 X |
| 4,515,227 | 5/1985 | Cerkovnik | 175/65 |
| 4,583,603 | 4/1986 | Dorleans | 175/234 |
| 4,850,440 | 7/1989 | Smet | 175/67 |

FOREIGN PATENT DOCUMENTS

| | | |
|---|---|---|
| 344618 | 11/1977 | Austria . |
| 871004 | 5/1971 | Canada . |
| 0195559 | 9/1986 | European Pat. Off. . |
| 3412319 | 6/1985 | Fed. Rep. of Germany . |
| 7902758 | 10/1980 | Netherlands . |
| 1086535 | 10/1967 | United Kingdom . |
| 2126267 | 3/1984 | United Kingdom . |
| 2161522 | 1/1986 | United Kingdom . |

OTHER PUBLICATIONS

Technik und Betrieb, Von Dipl.-Ing. Willi Prettin, Hattingen, Feb. 21, 1974, pp. 119-129.

*Primary Examiner*—Thuy M. Bui
*Attorney, Agent, or Firm*—Wolf, Greenfield & Sacks

[57] ABSTRACT

A drill head (1) as part of a drill lance for an apparatus for drilling an underground tunnel, which drill head has a channel (10) extending along the center axis of the drill lance and is rotatable about the center axis, comprising at least one forwardly directed nozzle (2), the nozzle channel (21) of which communicates with the channel (10) and exits outside the center axis, the drill head (1) being characterized by at least one rearwardly directed nozzle (4) being provided, the nozzle channel (41) of which communicates with the channel (10).

16 Claims, 3 Drawing Sheets

DRILL HEAD

FIELD OF INVENTION

The invention relates to a drill head as part of a drill lance for an apparatus for drilling an underground tunnel, comprising a drill head which has a channel extending along the center axis of the drill lance and is rotatable about the center axis, at least one forwardly directed nozzle on the drill head which communicates with the channel and the outlet opening of which is aligned outside the center axis.

BACKGROUND OF THE INVENTION

Such drill lances are used with apparatus which serve to drill underground channels. Fluid under pressure exits from the forwardly directed nozzle, for example a water-bentonite-milk. An even drilling in the forward direction through substantially homogeneous earth is achieved by rotating the drill head together with the drilling lance with an even rotational velocity about the center axis. When changes in direction are necessary, the rotational movement is stopped as soon as the nozzle of the drill head is located approximately in the position at which the change in direction is to begin. Earth is preferably only removed in one direction through the fluid jet emitting out of the nozzle. In accordance with the effected removal, the entire boring lance is turned until the new direction has been set. This hydromechanical steering is often supported by a control surface which is formed by a chamferring of the drill head located opposite the nozzle. The rotational movement of the drill head is then started again and a linear drilling ensues in the new direction.

Such a drill head for a drill lance is known from EP-0 195 559 A1. In order to take the various conditions in the earth into account, in particular its hardness, a different number of nozzles is selected accordingly. With this drill lance, sufficiently exact drillings can be carried out so long as the underground consists of relatively soft earth. In the case of hard earth material, difficulties arise in the stabilisation of the drill lance, as the side of the drilling lance lying opposite the nozzle arrangement hits against the hard rock which results in stearing problems with the lance during the relatively slow advance.

In order to be able to work hard earth all the same, it is suggested according to U.S. Pat. No. 2,324,102 to use chemicals or acids as high pressure fluid which attack the rock. As soon as the applied chemical has loosened the rock, the drill lance follows through as it only has to force its way through relatively soft material. This solution is often not desirable, as this results in impairment of the environment or the ground water.

It is an object of the invention to provide a drill lance with which directionally accurate drillings can be carried out in compact, sandy and gravelly ground as well as in hard ground. This object is solved by a drill lance of a type initially mentioned having the features of the characterizing clause of claim 1. Advantageous embodiments are outlined in the dependent claims.

SUMMARY OF INVENTION

The inventive drill head is characterized in that at least one rearwardly directed nozzle is provided on the drill head, the nozzle channel of which communicates with the channel extending along the center axis of the drill lance.

A nozzle directed in this way provides the drill lance with space so that it can manoeuver better during changes in direction. The steering capability of the drill lance is thus significantly improved.

According to an advantageous embodiment the drill head has a plurality of rearwardly directed nozzles which are provided at the same angular distance from one another with respect to the center axis, although embodiments with different angular distances are also possible. It has been determined that for certain ground conditions three nozzles aligned at a distance of 120° are sufficient in order to give the drill lance sufficient clearance during changes in direction of any kind. Other ground conditions can require a different arrangement of four or more rearwardly directed nozzles.

It is advantageous to direct the nozzles rearwardly at an angle of approximately 15° with respect to the center axis of the drill lance.

Although one forwardly directed nozzle which exits outside the center axis of the drill lance is sufficient in principle to also be able to carry out drilling with changes in direction, the drill head can also have a plurality of forwardly directed nozzles which are arranged symmetrically with regard to their angular distance to one of these nozzles. In such an arrangement of three nozzles, for example, the nozzle distance with respect to the central one of these nozzles respectively amounts to 45°. With this, the nozzles can be forwardly directed at an angle of approximately 10° to 15° with respect to the center axis of the drill lance, the outlet opening of the nozzles being aligned outside the center axis but arranged parallel to this. It is particularly expedient if the axis of the nozzle channel of at least one rearwardly directed nozzle and the axis of the nozzle channel of one forwardly directed nozzle lie in a plane common with the center axis. In this special nozzle arrangement together with the mentioned angles, the required quantity of bentonite for the drilling is smallest, which can be useful in some types of application.

BRIEF DESCRIPTION OF THE DRAWING

In the following, the invention shall be described in detail by means of an exemplified embodiment as shown in the enclosed drawing, in which.

DETAILED DESCRIPTION

Figure 1:
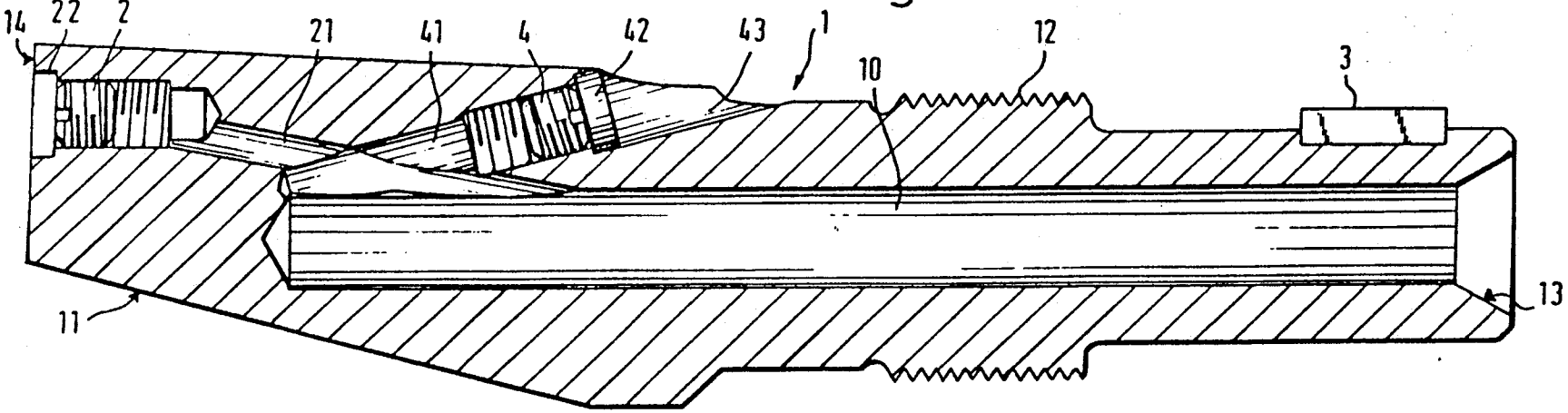
FIG. 1 shows a drill head according to the present invention in longitudinal section.

In FIG. 1, a drill head 1 is shown. Fluid under high pressure enters through the truncated cone-shaped opening 13 of a central channel 10 in the drill head 1. The center channel 10 extends almost up to the front surface 14 of the drill head 1. The drill head is coupled with the further apparatus necessary for drilling, a key 3 being provided to secure against rotation. The drill head 1 ends with a thread 12 by means of which it is possible to screw the drill head 1 to the apparatus additionally required for drilling. Nozzle channels 21, 41 of two nozzle systems enter into the end region of the center channel 10 in the vicinity of the front surface 14 of the drill head 1. The first nozzle system consists of forwardly directed nozzles 2 which exit into the front surface 14 of the drill head 1 outside the axis of the center channel 10. The second nozzle system comprises rearwardly directed nozzles 4, the respective outlet openings of which are directed against the actual advancing direction of the drill head 1 at a certain angle to the axis of the center channel 10, which angle can, for example, be 15°. In the drilling head 1, a recess 43 is provided in which the nozzle 4 is sunk. For both nozzle systems, known nozzles 2, 4 can be used which are provided with a hardened nozzle orifice blade 22, 42. The nozzle channels 21 of the first nozzle system are aligned at an angle of 11°, for example, with respect to the axis of the center channel 10. The first nozzle system is located in this depiction in the region above the axis of the center channel 10. The lower region is increasingly chamferred towards the front surface 14 and forms a control surface 11. During a change in direction of the drilling, this control surface 11 lies against the earth and contributes to the stabilisation of the drill lance.

Figure 2:
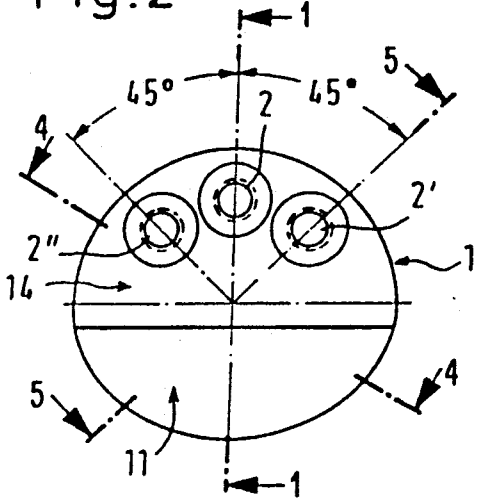
FIG. 2 shows a front view of the drill head.

FIG. 2 shows a front view of the drill head. Three nozzles 2, 2', 2'' exit into the front surface 14 of the drill head 1. Two of the nozzles 2', 2'' are displaced at an angle of 45° with respect to the centrally arranged nozzle 2. The arrangement of the control surface 11 implies that the drill head 1 has an elliptical section in cross section as a portion thereof.

Figure 3:
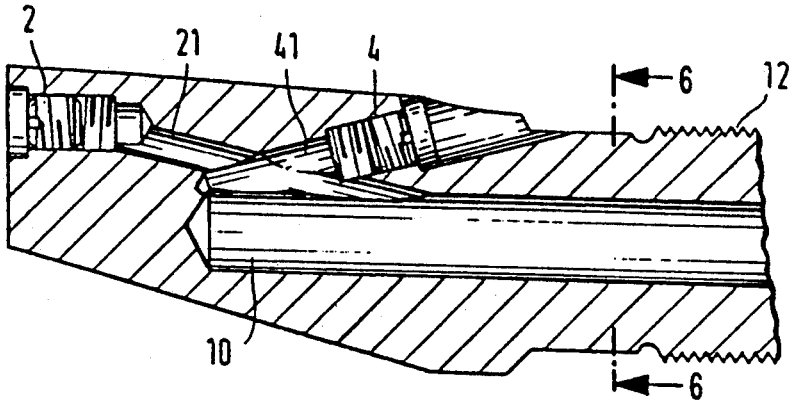
FIG. 3 shows a view of the drill head in section along the line A—A- in FIG. 2.

FIG. 3 shows the drill head of the lance as in FIG. 1 in section along the line A—A in FIG. 2. The sectional view clearly shows that the axes of the nozzle channels 21, 41 and the axis of the center channel 10 lie in one plane.

Figure 4:
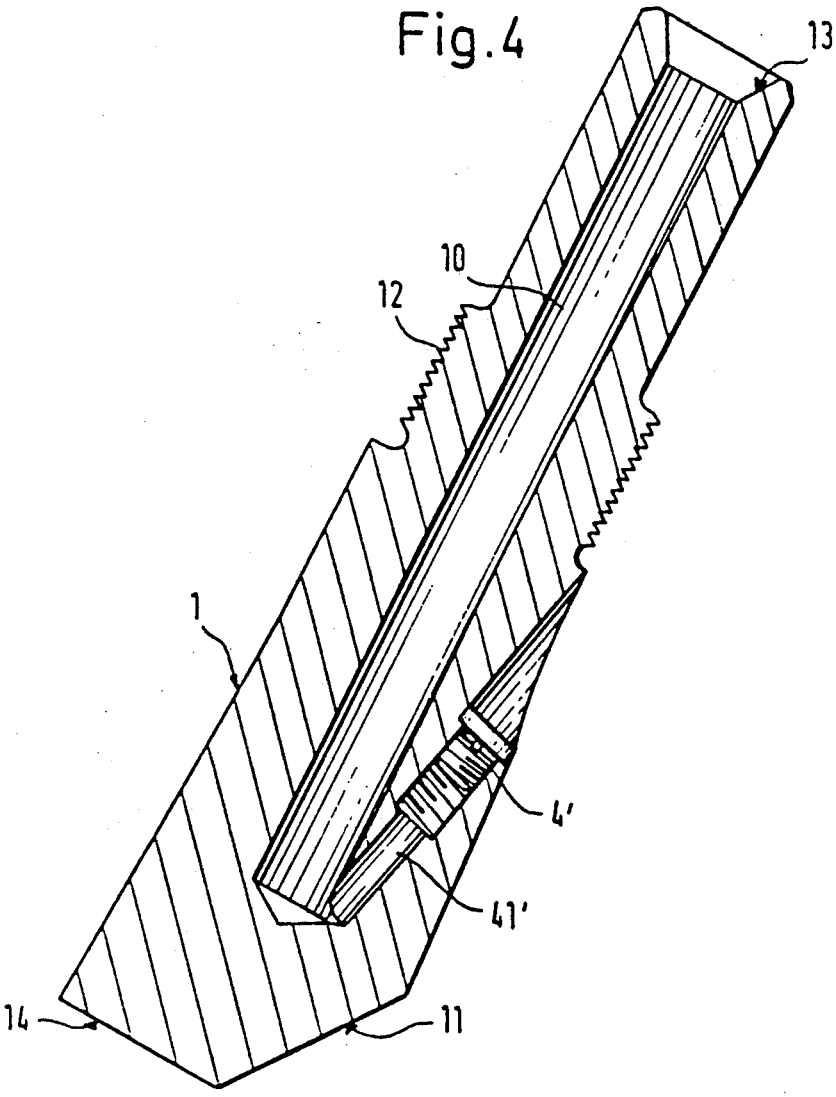
FIG. 4 shows a view of the drill head in section along the line B—B in FIG. 2.

FIG. 4 shows the drill lance in section along the line B—B in FIG. 2. The nozzle channel 41' of a second nozzle 4' of the second nozzle system, which is directed rearwardly in the advancing direction, enters at the end of the center channel 10. The elliptically-shaped cross section of the drill head 1 implies that the control surface 11 appears as a steeply chamferred surface in this sectional direction. Such a shaping of the control surface 11 effects a preferred direction during the drilling.

Figure 5:
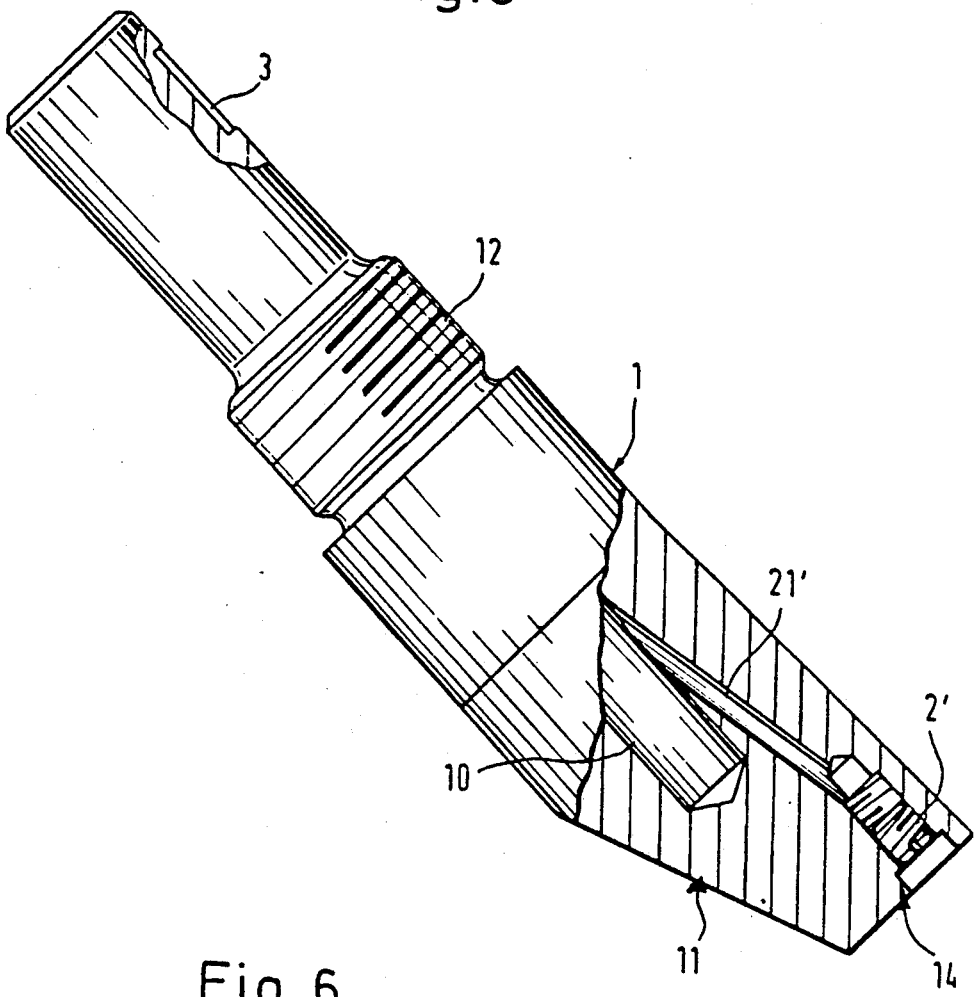
FIG. 5 shows a partially section view of the drill head, the section being shown along the line C—C in FIG. 2.

FIG. 5 shows the drill lance depicted partially in elevation, the section lying along the line C—C in FIG. 2. The drill lance is secured against rotation by a key 3 located in a keyway. Similarly as in the case of the nozzle channels of the associated first nozzle system, the nozzle channel 21' enters in the lower region of the center channel 10, but not at its end.

Figure 6:
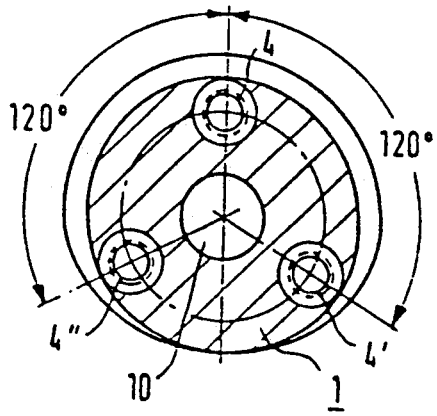
FIG. 6 shows a cross section view of the drill head along the line D—D in FIG. 3.

FIG. 6 shows the drill head of FIG. 3 in section along the line B—B in FIG. 2, wherein three nozzles 4, 4', 4'' are arranged at an angular distance of 120° from one another at the periphery of the drill head 1. This arrangement of the three nozzles 4, 4', 4'' is sufficient to ensure substantial evad movement of the drill lance while a change in direction is effected.

REFERENCE NUMBER LIST

1 Drill head
2 nozzle
3 key
4 nozzle
10 center channel
11 control surface
12 thread
13 truncated cone-shaped widening
14 front surface
21 nozzle channel
22 nozzle blade
41 nozzle channel
42 nozzle blade
43 recess

I claim:

1. Drill head for an apparatus for drilling an underground tunnel, the drill head having a central channel extending along a center axis thereof and being rotatable about the center axis, the drill head comprising:

a plurality of forwardly directed nozzles which each communicate with the channel, the forwardly directed nozzles each having an outlet opening that is aligned outside the center axis;

at least one rearwardly directed nozzle, the rearwardly directed nozzle having a nozzle channel that communicates with the central channel; and a plurality of forwardly directed nozzles which are arranged symmetrically based upon their angular distance with respect to one of the forwardly directed nozzles.

2. Drill head according to claim 1, wherein the plurality of forwardly directed nozzles comprises three forwardly directed nozzles and wherein two of the forwardly directed nozzles are disposed at 45°, taken from the center axis, on opposing sides of a third of the forwardly directed nozzles.

3. Drill head according to claim 2, characterized in that the forwardly directed nozzles are forwardly directed at an angle of approximately 10° to 15° with respect to the center axis of the drill head, each of the forwardly directed nozzles having a respective outlet opening and the outlet opening of each of the forwardly directed nozzles being aligned outside of the center axis and being oriented along a respective line parallel to the center axis.

4. Drill head according to claim 3, characterized in that forwardly directed nozzles each include a respective nozzle channel that communicates with the central channel and wherein an axis of the nozzle channel of the rearwardly directed nozzle and an axis of the nozzle channel of one of the forwardly directed nozzles lie in a common plane with the center axis.

5. A steerable drill head for an apparatus for drilling an underground tunnel, the drill head being rotatable about a center axis thereof and comprising:

a central channel extending along the center axis;

at least one forwardly directed nozzle which communicates with the central channel, the forwardly directed nozzle having an outlet opening which is aligned along a line remote from the center axis;

a control surface constructed and arranged to include a chamferred surface oriented at an angle wherein the chamferred surface slants in a direction toward the center axis when, along a direction from a rearward location to a forwardmost location on the drill head; and at least one rearwardly directed nozzle, the nozzle including a nozzle channel that communicates with the central channel, the rearwardly directed nozzle being constructed and arranged to direct fluid flow in a direction away from the forwardmost end of the drill head whereby the rearwardly directed nozzle produces a space in the tunnel for changing a direction of travel of the drill head.

6. A drill head according to claim 5 wherein the rearwardly directed nozzle is oriented along a line that defines an angle of approximately 15° with respect to the center axis.

7. A drill head according to claim 5 further comprising a plurality of forwardly directed nozzles, and wherein at least one of the forwardly directed nozzles includes a nozzle channel that communicates with the central channel.

8. A drill head according to claim 7 wherein each of the plurality of forwardly directed nozzles are disposed about the forwardmost end of the drill head at an equal distance from the center axis.

9. A drill head according to claim 8 wherein each of the plurality of forwardly directed nozzles is arranged on the forwardmost end of the drill head symmetrically about the center axis.

10. A drill head according to claim 8 wherein the plurality of forwardly directed nozzles comprises three forwardly directed nozzles.

11. A drill head according to claim 10 wherein each of the three forwardly directed nozzles is arranged, with respect to the center axis, on the forwardmost end of the drill head at 45° relative to an adjacent of the three forwardly directed nozzles.

12. A drill head according to any of claims 7-11 wherein the nozzle channel of each of the forwardly directed nozzles is oriented, in a direction taken toward the frontmost end of the drill head, at an angle of approximately 10° to 15° with respect to the center axis and wherein each of the nozzles includes an outlet opening, each outlet opening being aligned along a respective line remote from the center axis, each respective line being parallel to the center axis.

13. A drill head according to claim 5 wherein the nozzle channel of each of the forwardly directed nozzle is oriented, taken along a direction toward the forwardmost end of the drill head, at an angle of approximately 10° to 15° with respect to the center axis, the forwardly directed nozzle including an outlet opening that is aligned along a line remote from the center axis, the line being parallel to the center axis.

14. A drill head according to claim 5 wherein the rearwardly directed nozzle is aligned along an axis that lies in a common plane with the center axis.

15. A drill head according to claim 14 wherein the nozzle channel of the forwardly directed nozzle lies in the common plane.

16. A drill head according to claim 15 further comprising a plurality of forwardly directed nozzles disposed about the forwardmost end of the drill head.

* * * * *